United States Patent [19]

Honda et al.

[11] Patent Number: 4,811,496

[45] Date of Patent: Mar. 14, 1989

[54] METHOD OF CORRECTING THE TRACK OF AN INTERMITTENTLY-RUNNING ENDLESS BELT IN A VENEER DRYER

[75] Inventors: Noriyuki Honda; Yukio Abe; Makoto Isobe; Nobuhiro Nakata, all of Obu, Japan

[73] Assignee: Meinan Machinery Works, Inc., Obu, Japan

[21] Appl. No.: 114,197

[22] Filed: Oct. 28, 1987

[51] Int. Cl.[4] ..... F26B 9/04

[52] U.S. Cl. ..... 34/144; 34/162; 198/840

[58] Field of Search ..... 34/162, 144; 198/806, 198/807, 809, 840

[56] References Cited

U.S. PATENT DOCUMENTS

| | | | |
|---|---|---|---|
| 3,896,559 | 7/1975 | Martin | 34/162 |
| 3,973,446 | 8/1976 | Vasilantone | 198/806 X |
| 4,367,031 | 1/1983 | Hamaker | 198/840 X |
| 4,421,228 | 12/1983 | Marsiglio et al. | 198/840 X |

*Primary Examiner*—Steven E. Warner

*Attorney, Agent, or Firm*—Brooks Haidt Haffner & Delahunty

[57] ABSTRACT

Method of correcting the track of an intermittently-running endless belt in a veneer dryer is disclosed. In a veneer dryer having a pair of intermittently movable endless belts provided under tension so as to form at least one straight passage therebetween through which a veneer sheet is conveyed by the endless belts while being heated by heating plates located above and below the passage, and means disposed adjacent to the opposite lateral edges of the endless belts and movable toward and away from said lateral edges for moving the belts laterally, the tension is released to loosen the belts after a predetermined number of stops of the endless belts and the belts are then moved at the edge thereof on the side corresponding to the direction in which they are displaced, by said means located adjacent to said edge, until an area of normal running track is reached by the belts.

14 Claims, 8 Drawing Sheets

PRIOR ART

PRIOR ART

METHOD OF CORRECTING THE TRACK OF AN INTERMITTENTLY-RUNNING ENDLESS BELT IN A VENEER DRYER

FIELD OF THE INVENTION

The present invention relates to a method of correcting the track of an intermittently movable endless belt in an apparatus for drying wood veneer.

BACKGROUND OF THE INVENTION

In a known form of apparatus for contact drying sheets of wood veneer, a pair of endless belts is mounted over and driven intermittently by guide rolls to advance a veneer sheet between said belts through the apparatus and also to allow heat from heating plates to be conducted through said belts to the veneer sheet to be dried. The heating plates are disposed above and below the belts, respectively, and the plate at least on one side is movable alternately into its operative or heating position then with the endless belts at a stop and away from said heating position then with the belts in movement for advancing the veneer sheet. Thus, the veneer sheet can be dried progressively by repeated application of heat through the belts while being forwarded intermittently therewith through the dryer. The structure of the dryer of this type is disclosed by Publications (or Kokoku) of Japanese Utility Model Application No. 59-34872 (1984) and of Japanese Patent Application No. 60-12547 (1985), both assigned to the same assignee as the present application, laid open to public opposition, respectively. Incidentally, the basic arrangement of the endless belts, guide rolls and heating plates with respect to the veneer sheets to be dried is shown in FIG. 1 accompanying herewith.

Though this type of veneer dryer is known to be advantageous in simplicity of construction, improvement of thermal efficiency and ease of control, as compared with a conventional veneer dryer of hot air type, it is not practically applicable to mass production of dried veneer.

For accomplishing an increase of production capacity in drying veneer sheet having a normal thickness with the above dryer using a pair of intermittently-running endless conveyer belts to an extent obtainable by conventional hot air type dryers, it would be necessary either to provide plural pairs of endless conveyer belts in a multiple-tier arrangement or to form a single tier of veneer veneer passage long enough to handle a number of sheets at a time. However, provision of the multiple tiers of veneer passage make it troublesome to handle the sheets at feeding and delivery sides of the dryer because it will have plural inlets and outlets for green and dried veneer, respectively. The use of the latter dryer having a long veneer passage requires accordingly a large space for installation of the machine. Therefore, application of such dryers is impractical to mass production of dried veneer in veneer of plywood mills of an ordinary size and their possible application is limited to drying extra-thick vener sheets which are difficult to be dried by hot air type dryer.

The above problems may be solved by providing guide rolls of plural pairs in such a staggered arrangement that the endless belts trained round such rolls may form a veneer passage having a series of rounded turns in alternating directions. It is known, however, that other problems arise in such an arrangement which seriously affect the smoothness and stability of movement of the endless belts, if they are made of a loop of thin metal plate having very little resiliency unlike, e.g. net of metal wires.

Because the application of heat to veneer sheet by heating plates is accomplished by conduction through the endless conveyer belts, it is advantageous to form the belts from a thin metal band having high heat conductivity and sufficient strength. As a disadvantage, on the other hand, such metal belt has very little resiliency. When a pair of such belts are moved in a winding course of alternating directions while being guided by rolls disposed in a staggered arrangement, the two belts run at different speeds round the periphery of a roll because of the difference in radius of curvatures between the two belts round the periphery of the roll, with the outer belt moving faster than the inner belt, which results in slackening of the belts. Furthermore, the inner belt at a curved turn is inevitably restricted or held down directly by the outer belt, or indirectly by way of a veneer sheet held between the belts. In addition, the belt movement through the alternate turns causes the belts to be bent in opposite directions alternately, and the restriction of one belt by the other and also the difference in speed round the peripheries of rolls between the two belts are varied similarly in an alternate manner. Though the endless belts are usually placed under a tension to pull in the slack produced therein, the endless belts of the above arrangement are unable to absorb such slack. It is because there exists an area in the veneer passage which is located between two guide rolls where one belt is held down by the other and, therefore, the slacking in the belt in that area cannot be taken up by the tension to the belt. Such slack in the belt tends to be increased with continuation of the movement of the belts along the winding passage, which affects seriously the smoothness and stability of belt operation. Such behavior of the endless belts made of a rigid material such as steel sheet has been observed by the experiments conducted by the present inventors. Thus, it is quite impractical to use a pair of such endless belts of the above arrangement for successfully transferring a veneer sheet in a contact-type veneer dryer.

For better understanding of the characteristics of metal endless belts used for the above conveying purpose, their behavior in operation will be described more concretely with reference to FIGS. 10 and 11 accompanying herewith. In the drawings, a pair of endless belts 21, 22 is provided to as to be moved round, while being guided by, rolls 22*a*, 21*a*, 22*b*, 21*b* and other rolls (not shown) which are located in a staggered arrangement, and a veneer sheet designated by symbol T is conveyed along a winding passage defined by the endless belts and having a series of turns in alternating directions, moving intermittently therewith while being held or sandwiched therebetween.

As the veneer sheet T is moved from the dash-line position round the periphery of the roll 21*a* to the solid-line position in the straight passage between the rolls 21*a* and 22*b*, there is produced a slack in the belt 22 because it has to move a longer distance round the periphery of the roll 21*a* than its counterpart 21 because of the reason stated previously. Since the belt 22 is held down by the other belt 21 round the rolls 22*a* and 22*b*, the slack produced in the belt 22 cannot pulled in by the tension applied thereto, but remains therein in the area between two such rolls 22*a* and 22*b*, as shown in FIG. 11.

The same is true of the other belt 21 which will have to move a longer distance than the belt 22 round the roll 22*b*. Consequently, a slack is produced in the belt 21 which cannot be taken up because of its restriction by the belt 22 in the area of veneer passage between the rolls 22*b* and 21*b*.

This phenomenon of slackening tends to become more remarkable when another veneer sheet is then present round the periphery of the roll 22*a* in addition to the sheet T shown round the periphery of the roll 21*a*. It is noted that the locations and amount of belt slackening are varied according to various influencing factors such as position of the rolls, relative position of one veneer sheet to another in the passage, coefficient of friction between the veneer sheet, rolls and belts, etc. Though stronger tension may be applied to either of the belts with an attempt to take up its slack, it will inevitably increase the restriction thereby of the other belt, which means that the slack in the latter belt has no way to be pulled in. In any way, it is unavoidable to have slacking produced in the endless belts, and thus impractical in the above staggered arrangement of drive rolls to allow the endless belts to move round such rolls without producing belt slackening which causes difficulty in feeding veneer sheets with smoothness. This has been verified by the experiments conducted by the present inventors.

Reference is then had to FIG. 12 showing an example of relative arrangement of endless belts to guide rolls, which offers an improvement over that described with reference to FIGS. 10 and 11. This arrangement includes a longer endless belt 31 trained around a plurality of guide rolls 31*a*, 32*b*, 31*d*, 31*c* and 31*b* which are disposed in a staggered manner, and a short endless belt 32 mounted over a pair of rolls 32*a* and 32*b*. As shown in the drawing, this configuration has only one location where the two belts are moved together round a roll, namely the roll 32*b*, and, therefore, any slack in the belt 31 caused by the difference in speed between the belts can be successfully absorbed by the tension applied to the belt, thus posing no fear of troubles that have been described previously. With this structure wherein the inlet for green veneer to be dried and the outlet for dried veneer are provide on the same side of the machine, or on the left-hand side as seen in FIG. 12, it offers a serious disadvantage in that the flow of veneer processing in the whole production line is reversed in this drying station, thereby making it difficult to install the machine in an ordinary streamlined production line. Though the apparatus can provide an advantage in terms of space factor, it is not so important in view of its disadvantage.

Then, reference is made to FIG. 13 showing a known arrangement of conveyer belts and their guide rolls, which is primarily designed for conveying sheet materials not limited to wood veneer. The apparatus includes plural pairs of guide rolls 41*a*, 42*a*, 51*a*, 52*a*, 61*a*, 62*a* (only one of each pair being shown), endless belts 41, 42, 51, 52, 61, 62 each trained over the rolls of each pair, plural sets of small rolls, each set including 71*a*, 71*b*, 71*c* and 72*a*, 72*b*, 72*c*, disposed adjacent to the peripheries of the rolls 42*a* and 52*a*, respectively, and short endless belts 71, 72, installed over the small rolls of each set and driven thereby at a surface speed which is slightly lower than that of the long endless belts. It is noted that similar sets of small rolls and short endless belts are provided at rolls (not shown) on the left end of the loops of endless belts 51 and 61, respectively. With this apparatus, although there is no problem associated with mutual interference or restriction between the endless belts, not only its structure becomes complicated by addition of small rolls and their associated short endless belts, but also part of the passage at large rolls, e.g. rolls 42*a* and 52*a* in FIG. 13, forms an open space where veneer sheets, if fed through the passage, in particular narrow sheets, tend to fail to be transferred smoothly, as indicated by irregularly bend sheets. Thus, this arrangement of endless belts and rolls cannot provide an effective solution and its application to a veneer dryer of the aforementioned type is impractical.

As it would be apparent from the foregoing description, it had been presumed difficult in a veneer drying machine to realize a usable arrangement of guide rolls disposed in a staggered manner and non-resilient metal endless belts trained over such rolls thereby to form a veneer passage having a series of turns in alternating directions. Attempts had been made to partially overcome this presumption by improving the arrangement. Such an improvement is shown by Japanese Patent Applications No. 61-237679 (1986) and No. 61-238644 (1986) for "Veneer Drying Apparatus", both assigned to the same assignee as the present application.

In the veneer dryer according to the Japanese Patent Application No. 61-237679, which is basically the same in respect of the arrangement of guide rolls and endless conveyer belts as the apparatus shown in FIG. 5, a pair of endless belts are trained around a plurality of staggered rolls to form a veneer passage comprising a combination of three straight, flat passages and two curved passages each located so as to connect the ends of any two adjacent straight passages. In other words, the apparatus features in that it forms a winding veneer route comprising top, middle and bottom straight passages where the veneer sheets are heated for drying while being advanced between the intermittently-moving endless belts and two curved passages, one located between the terminating end of the top heating passage and the beginning end of the middle passage and the other between the terminating end of the middle passage and the beginning end of the bottom passage.

On the other hand, the veneer drying apparatus according to the Japanese Patent Application No. 61-238644 differs from the above dryer in that an appropriate number of pairs of cooling plates are provided with at least one of such plates of a pair being movable toward and away from the endless belts and at least one pair of such cooling plates being located at the end of the veneer passage.

These dryers can be installed in a limited space and make it possible to accomplish smooth and stable feeding operation. With the latter apparatus having cooling plates, the veneer sheet can be hardened by cooling effect by the cooling plates and, therefore, deformation caused by drying can be forestalled successfully. Though both dryers could offer various advantages and be usable successfully in veneer and plywood mills handling a large volume of veneer, there has arisen a problem associated with maintenance of the endless belts within a permissible area for running track thereof during their operation.

In a combination having an appropriate number of rolls and an endless belts trained over such rolls under tension and adapted to run round the rolls while being guided thereby, it has been an usual practice for correction of the running track of the belts to provide a pair of detectors at the opposite lateral sides of the belt for monitoring the lateral displacement or swerving motion of the endless belt and to tilt the associated roll axially in response to a signal from the detectors so that the track of the endless belt may be corrected gradually by the difference in tension of the belt between its axial ends.

This method for correcting the running track of an endless belt which relies on the difference in tension of the belt created by axially tilting the roll is found ineffective in the veneer dryer of the above-mentioned type in which the metal endless belts tends to be temporarily shrunk or contracted locally due to their contact with green and hence cold veneer sheet just being fed into the dryer, and the location and coefficient of such contraction vary depending on various influencing factors which are difficult to predict, such as shape, moisture content, etc. of veneer sheets to be dried. As a result, the time of belt track correction tends to be delayed or even disabled, thereby causing the belts to move far away from the permissible area of belt track. According to the results obtained from our experiments, with the veneer drying apparatus according to the referred to Japanese Patent Application No. 61-237679 or No. 61-238644 wherein one of the endless belts of a pair is held down by the other at each curved turn and their tight and loose sides are reversed each time they are moved past a turn, it has been found that the amount and direction for correction of the belt track in relation to the axial displacement of the roll is varied unpredictably. Thus, it has been very difficult to secure stabilized movement of endless belts for a substantial period of time in operation with the above veneer dryer.

SUMMARY OF THE INVENTION

Therefore, it is an object of the present invention to provide a method of correcting the running track of a pair of endless belts for stabilizing their movement in a veneer drying apparatus.

The method according to the present invention can be used advantageously in such a veneer dryer in which a pair of intermittently movable endless belts is provided under tension so as to form at least one straight passage therebetween through which a veneer sheet is conveyed by the endless belts while being heated by heating plates which are located above and below the passage, respectively. The dryer includes means disposed adjacent to the opposite lateral edges of the endless belts and movable toward and away from said edges for moving the belts, if then displaced in either direction, back to an area for their normal track of running. According to the invention, the tension of the intermittently moving endless belts is released after each predetermined number of stops of the belts and then the belts are caused to be moved laterally by said moving means in either direction which is opposite to a lateral direction in which the belts are then displaced so that they may be moved back into the area for their normal running track.

The use of the method of the present invention can realize smooth and stable operation of intermittently moving endless belts in a veneer dryer which uses such belts for advancing a veneer sheet therebetween through the dryer and also allowing heat from heating plates to be conducted therethrough to the veneer sheet to be dried. Therefore, the method can make possible practical use of the veneer dryer of this type which is, as compared with a conventional veneer dryer of hot air type, simple in construction and advantageous in thermal efficiency and ease of control.

These and other objects, features and advantages of the invention will become apparent to those skilled in the art from the following description of a preferred embodiment of veneer handling apparatus according to the present invention, which description is made with reference to the accompanying drawings.

DETAILED DESCRIPTION OF PREFERRED EMBODIMENT

Figure 1:
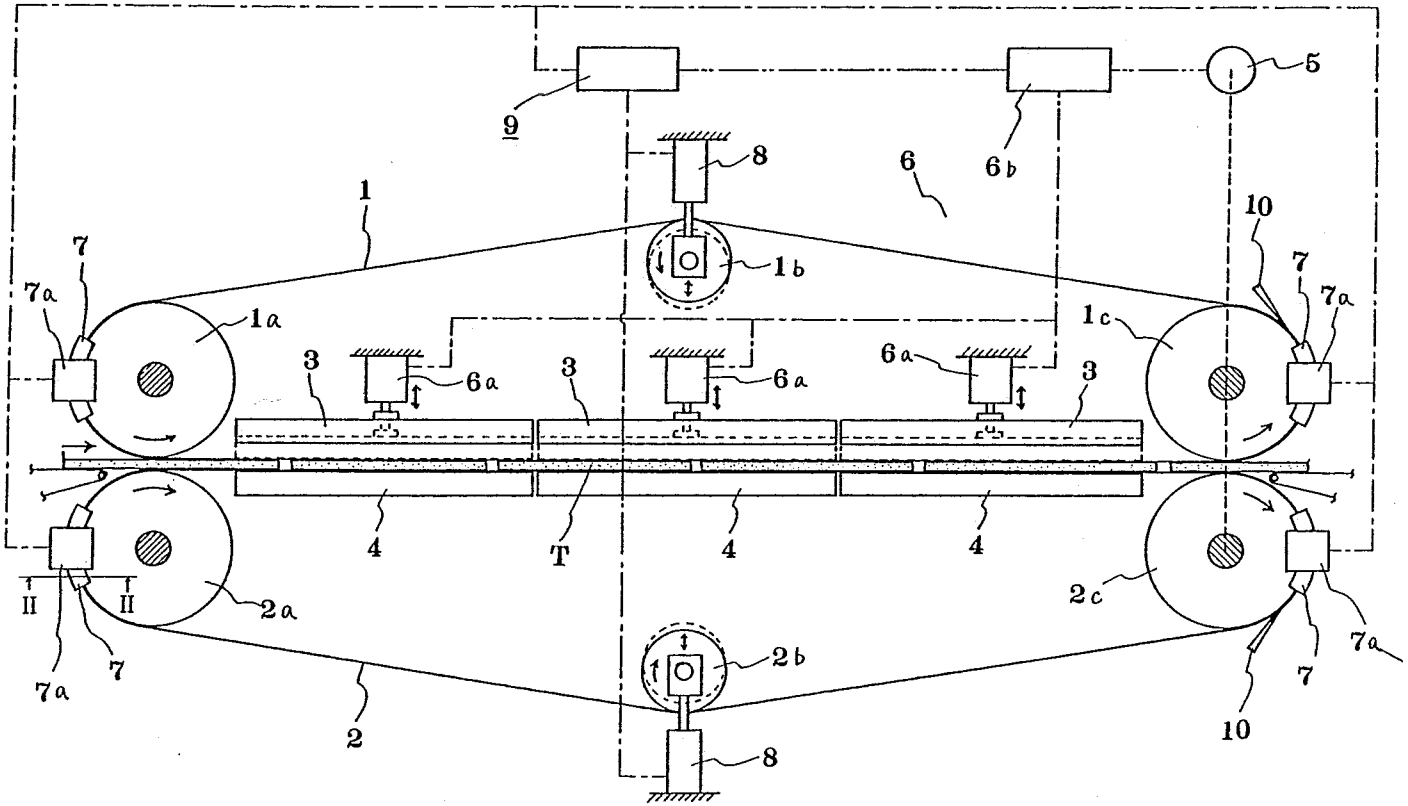
FIG. 1 is a schematic diagram in side elevation showing part of a veneer dryer having a single straight veneer passage formed by a pair of endless belts, and heating plates movable into pressing contact with the adjacent endless belt, in which the method according to the present invention can be performed.
Figure 2:
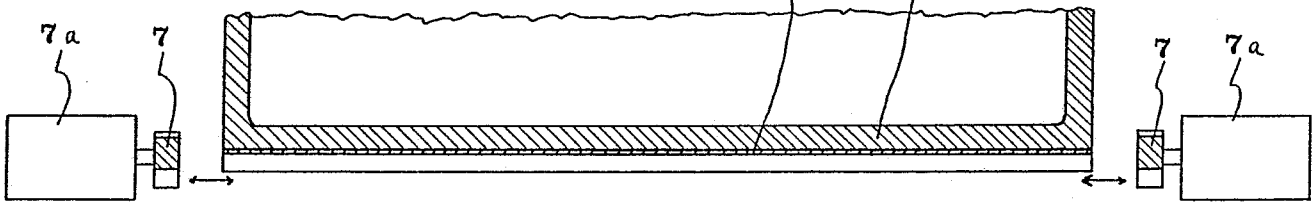
FIG. 2 is partial cross-section taken along the line II—II of FIG. 1, showing means for correcting the track of endless belts.

Referring to FIGS. 1 and 2, reference numerals 1 and 2 designate a pair of endless belts each made preferably of stainless steel. These endless belts 1, 2 are installed under tension over sets of rolls 1*a*, 1*b*, 1*c* and 2*a*, 2*b*, 2*c*, respectively, in spaced and facing relation to form therebetween a straight, flat heating passage for veneer sheets T. The rolls 1*c* and 2*c* are driven intermittently in arrow directions by a drive 5 including an electric motor and reduction gearbox, thereby rotating the endless belts 1, 2 so as to move the veneer sheet T intermittently with the belts in arrow direction (or rightwards in FIG. 1).

Reference numerals 3 denote a plurality of sectional top heating plates disposed above the veneer passage and heated at a desired temperature by any suitable medium such as steam. The plates 3 are movable vertically, as indicated by double-head arrows, into pressing contact with and away from the inner surface of the loop of the endless belt 1 in an intermittent manner by a drive mechanism 6 in such timed relation to the intermittent movement of the endless belts 1, 2 that the movable plates 3 may be moved into contact engagement with its associated endless belt 1 synchronously with each stop motion of the belts. When moved to their lowered position in pressing contact with the endless belt 1, as shown by dash lines, the plates 3 apply heat to the veneer sheets T by way of the belt thereby to remove moisture in the sheets.

The drive mechanism 6 includes an actuator such as piston-cylinder unit **6*a* whose piston rod is connected to each top heating plate 3, and a first control unit 6*b* which is connected to the actuators 6*a* and also to the drive 5 and adapted to operate on the actuators 6*a* in such a way that the top plates 3 may be moved down into contact with the endless belts 1, 2** synchronously with each stop of the belts during their intermittent movement.

Reference numerals 4 designate a plurality of sectional stationary bottom heating plates corresponding to the top plates 3 in number and disposed below the veneer passage. The plates 4 are also heated at the desired level of temperature and held in contact with the inner surface of the loop of the endless belt 2 so as to apply heat to the veneer sheets T through belt 2.

Numerals 7 depict four pairs of pushers, the pushers of each pair being provided adjacent the peripheral edges on opposite sides of each of the rolls **1*a*, 1*c*, 2*a*, 2*c*, as shown in FIG. 2, for pushing the endless belt 1 or 2, if it is then displaced in either direction, back to a permissible area for their running track. Each pusher 7 has an arc shape whose curvature is substantially matched with that of the roll's periphery and is made of any suitable materials such as hard rubber, synthetic resin, metal, etc. The pushers 7 are operated by actuators such as piston-cylinder units 7*a* which are connected to a second control unit 9 which is in turn connected to the first control unit 6*b***.

The rolls **1*b* and 2*b* are movable toward and away from each other by operation of actuators 8 such as piston-cylinder units 8 for releasing and applying tension to the endless belts 1 and 2, in response to control signals emitted from the second control unit 9 according to the operation of the drive 5. During normal operation of the dryer, the tension rolls 1*b* and 2*b* are both placed in solid-line positions to apply an appropriate tension to the endless belts 1, 2 to thereby take up slack in the belts. When moving the endless belts 1, 2 laterally for correction of their running track by the pushers 7, the tension rolls 1*b* and 2*b* are moved toward each other to the dotted-line positions to loosen the belts 1, 2**.

It is so arranged that, each time the endless belts 1, 2 make a predetermined number of stops during their intermittent movement, the actuators 8 are operated by the second control unit 9 to loosen the endless belts 1 and 2 and then the actuators **7*a* are operated by the first control unit 6*b* to advance the pushers 7** for moving the endless belts in either lateral direction for correction of their running track.

Scraping means 10 is provided adjacent each pusher 7 in engagement with the outer surface of the loop of the endless belt for scraping off attachments on the belt surface, such as resins, wood chips, etc. The scraping means 10 may be made of a flat spring which can be kept urged in contact at its tip with the belt surface by spring action. A known brush is also usable for the purpose.

The operation of the apparatus thus constructed will be described in the following.

The veneer sheets T fed successively by any suitable conveyer into the veneer dryer are advanced intermittently through the veneer passage by the endless belts 1, 2. During the intermittent movement of the endless belts, the top heating plates 3 are caused to lower by the actuators **6*a* into pressing contact with the inner surface of the upper endless belt 1 synchronously with each stop motion of the endless belts. The top and bottom heating plates 3 and 4 thus apply heat through the belts 1, 2 to the veneer sheets T for drying. With an elapse of a predetermined length of time after the contact with the belt 1, the top plates 3 are moved up away from the belt 1. Simultaneously, the belts 1 and 2 are started again to move for a predetermined length of distance. After movement of the endless belts 1 and 2 with the veneer sheets T for the above distance, they are stopped again with simultaneous movement of the top heating plates 3 down to their operative heating positions. Such movement and stop are repeated during the intermittent movement of the endless belts 1, 2**, and the veneer sheets T are dried progressively and finally delivered out of the dryer at the right end thereof.

After each predetermined number of stop motions of the endless belts 1, 2 during the intermittent movement thereof, the second control unit 9 receives a control signal from the first control unit **6*b* and operates on the actuators 8 thereby to move the tension rolls 1*b* and 2*b* in the direction which causes the endless belts 1, 2 to be loosened. Simultaneously or with a short delay, the control unit 9 provides a signal to the actuators 7*a* which in turn act on their associated pushers 7 so that the endless belts 1, 2** may be pushed back to the area for their normal running track if they are then displaced from such area.

Figure 5:
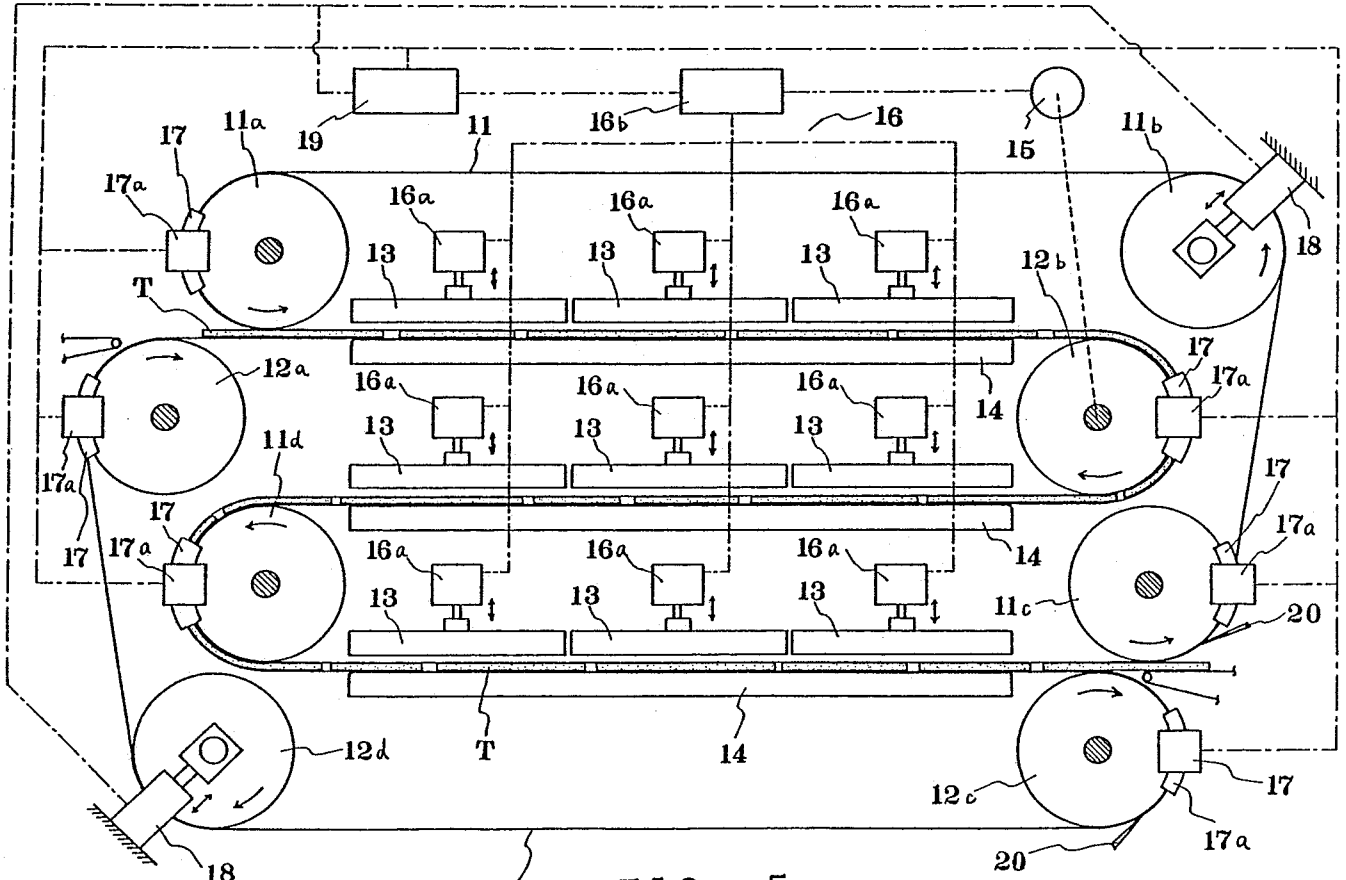
FIG. 5 is a schematic diagram in side elevation showing a veneer dryer having three straight veneer passage formed by a pair of endless belts, and heating plates movable into pressing contact with the adjacent belts, in which the method according to the present invention can be performed.
Figure 6:
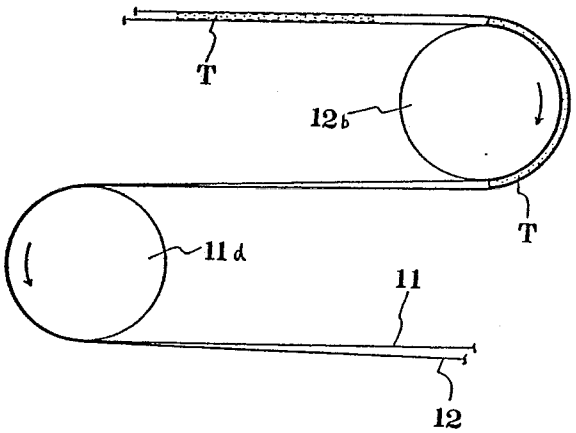
FIGS. 6 through 9 are schematic diagrams illustrating the processes of veneer sheet feeding in the dryer of FIG. 5 according to the sequence of advancement of a veneer sheet.
Figure 7:
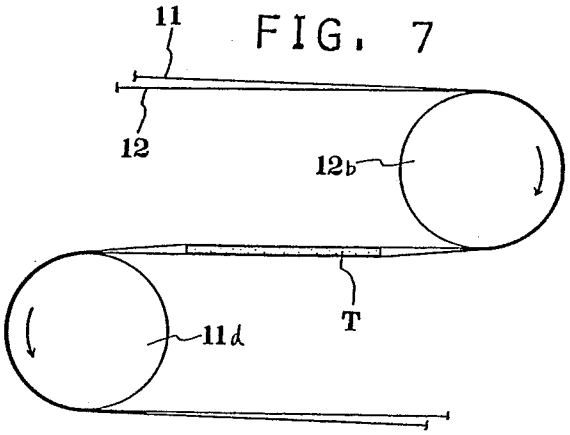
Figure 8:
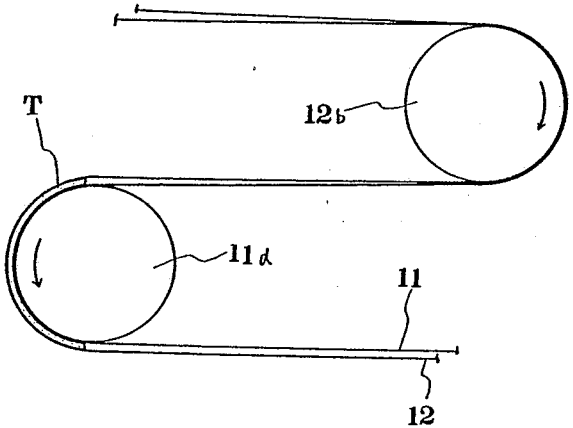

FIG. 5 shows a veneer drying machine which provides the same arrangement of guide rolls and endless belts of a pair as that discussed earlier in relation to the Japanese Patent Application No. 61-238644 but an improved version thereof so as to permit the practice of the method according the to present invention. This veneer dryer includes a pair of steel endless belts 11 and 12, one belt 11 being trained over **11*a*, 12*b*, 11*d*, 11*c* and 11*b* and the other belt 12 over 12*a*, 12*b*, 11*d*, 12*c* and 12*d*, respectively, forming a continuous veneer passage of a winding form which comprises top, middle and bottom straight heating passages and two curved passages or turns, one turn extending round the periphery of the roll 12*b* between the terminating end of the top heating passage and the beginning end of the middle passage and the other turn extending round the periphery of the roll 11*d* between the terminating end of the middle passage and the beginning end of the bottom passage. The roll 12*b* is intermittently driven to rotate in arrow direction by a drive 15 which is connected to a control unit 16*b*. A stationary bottom heating plate 14 is located below each straight heating passage, and sectioned movable top heating plates 13 are provided above each such passage. The latter top heating plates 13 are moved vertically, as indicated by double-head arrows, into pressing contact with and away from their adjacent belts 1 and 2 alternately by a drive mechanism 16 including the control unit 16*b* and actuators 16*a* such as piston-cylinder units connected to the plates 13 and to said control unit 16*b*, in timed relation to the intermittent movement of the endless belts so that the actuators 16*a* may be operated to lower the plates 13 into engagement with the belts synchronously with each stop motion of the roll 12***b* during its intermittent rotation.

The rolls 11*b* and 12*d* can be moved back and forth by operation of their actuators 18 such as piston-cylinder units, respectively, for applying and releasing tension to the endless belts 11 and 12, in response to control signals provided by a second control unit 19 which is connected to the first control unit 16*b*. A pair of pushers 17 is provided adjacent the peripheral edges on opposite sides of each of the rolls 11*a*, 11*c*, 11*d*, 12*a* 12*b* and 12*c*, as shown in FIG. 5, for pushing the endless belts laterally thereby to return the belts to an area of their normal running track if they are then displaced in either direction from that area. The pushers 17 are operated by their corresponding actuators 17*a* such as piston-cylinder units to move toward and away from the ends of the rolls, hence the edges of endless belts 11, 12. The control 19 operates in such a way that, after each predetermined number of stop motions of the endless belts 11, 12 in their intermittent movement, the actuators 18 may be operated to move the tension rolls 11*b* and 12*d* in the direction to loosen the belts and then the actuators 17*a* may be operated to move the pushers 17 toward the ends of the corresponding rolls so as to return the endless belts 11, 12 back to the area of their normal running track.

Reference numerals 20 refer to scraping means which is similar to the counterpart 10 shown in reference to the previous embodiment.

Figure 9:
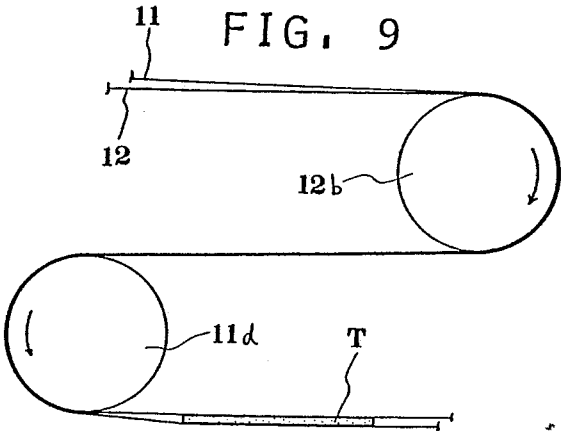
Figure 10:
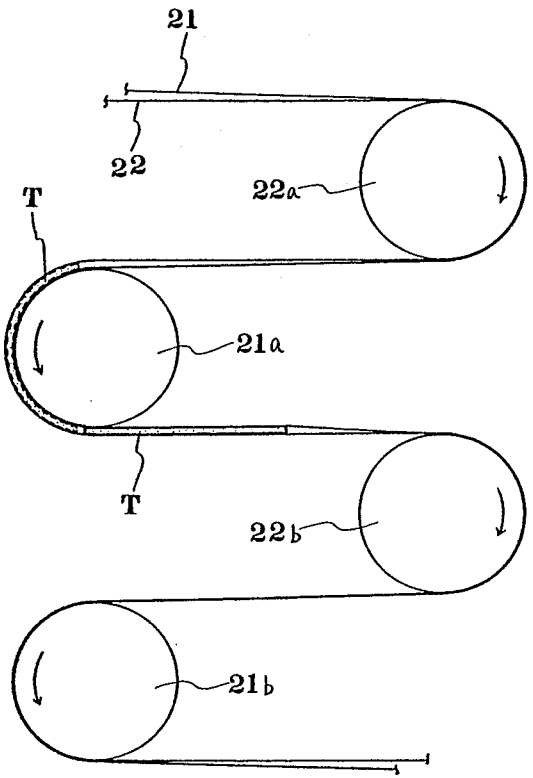
FIGS. 10 and 11 are schematic diagrams showing the problem encountered in prior art.
Figure 11:
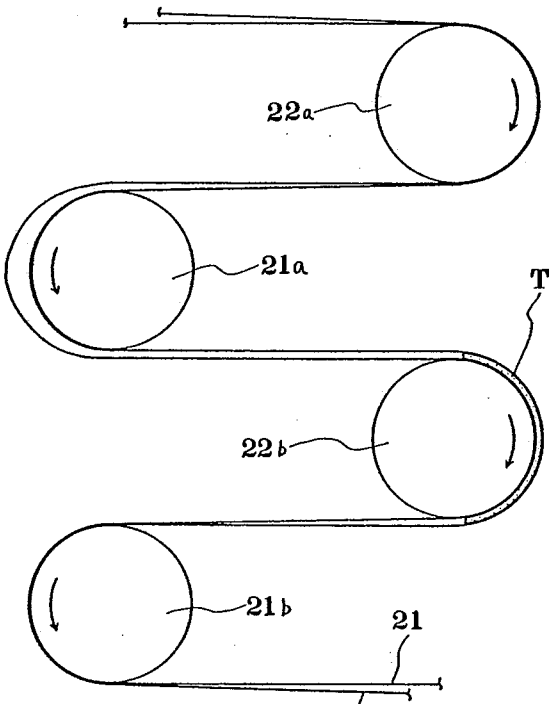
PRIOR ART FIG. 11
Figure 12:
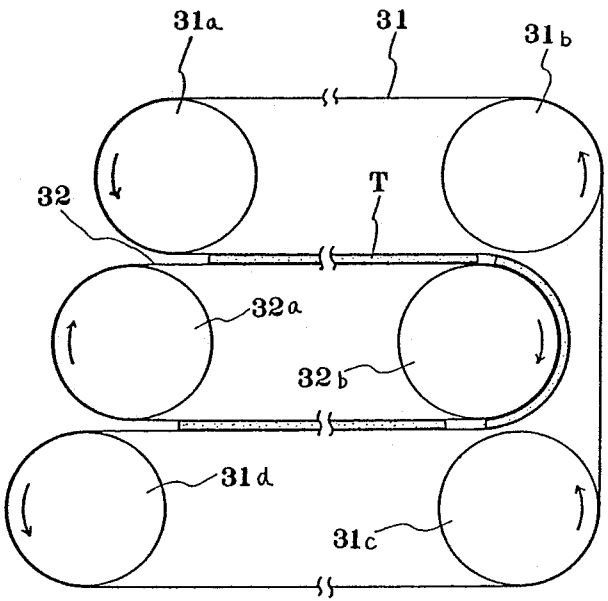
FIGS. 12 and 13 are schematic diagrams in side elevation showing prior art arrangements which have been found having drawbacks in veneer transferring in a veneer dryer.
Figure 13:
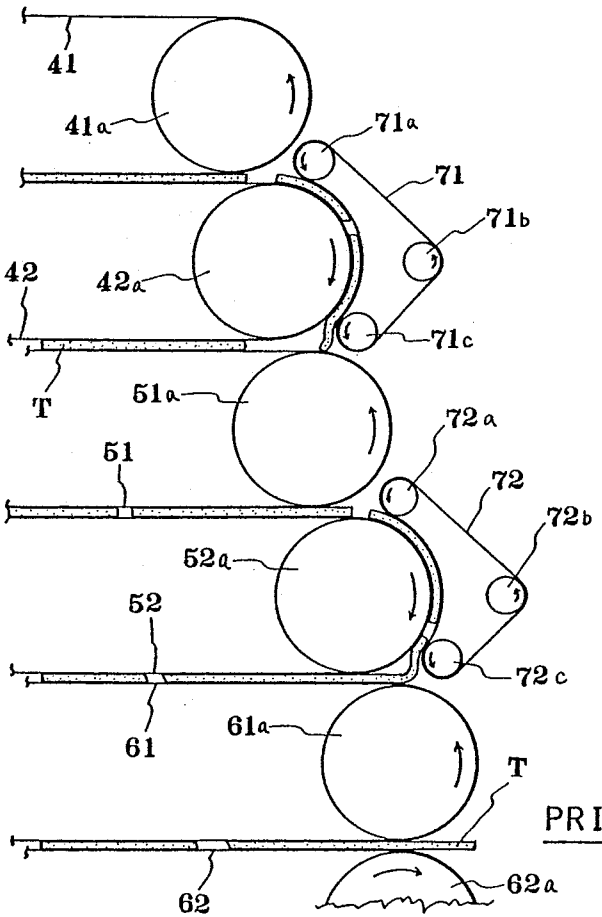
PRIOR ART FIG. 13

Reference is had to FIGS. 6 through 9 which show the manner in which the endless belts 11 and 12 of a pair act on each other when a veneer sheet T is conveyed from a position in the top tier of straight passage as indicated by dotted line (FIG. 6) through the curved passage round the periphery of the roll 12*b*, middle straight passage (FIG. 7), curved passage round the periphery of the roll 11*d* (FIG. 8), and the bottom straight passage (FIG. 9). It is noted that the endless belt 11 is restricted by the other belt 12 in the area round the periphery of the roll 11*d*, but the portion thereof then extending upstream round the periphery of the roll 12*b* and toward the roll 11*a* (not shown) is free from such restriction. Therefore, the endless belt 11 can smoothly follow the curve defined by the roll 12*b* and the thickness of the veneer sheet T, and a slack of the belt 11, if produced, can be taken up successfully by the tension roll 11*b*. Similarly, the endless belt 12 which is restricted by the other belt 11 round the periphery of the roll 12*b*, but is free from such restriction on the downstream side extending round the periphery of the roll 11*d* and toward the roll 12*c* (not shown), can make a smooth turn round the periphery of the roll 11*d*, and the tension roll 12*d* can work effectively to pull in any slack produced in the belt 11.

As it is apparent from the foregoing, in spite of that the veneer dryer of FIG. 5 has formed therein a veneer passage of a winding circuit, a slack produced in the endless belts by the difference in speed therebetween when moving round the rolls can be absorbed instantly by the tension applied to the belts.

The manner in which the endless belts 11, 12 are moved for their track correction in the veneer dryer of FIG. 5 will be described in the following.

The veneer sheets T fed successively by any convenient conveyer into the veneer dryer are advanced intermittently through the winding veneer passage by the endless belts 11, 12. During the intermittent movement of the endless belts, the top heating plates 13 are caused to lower by the operation of the actuators 16*a* into pressing contact engagement with the surfaces of the adjacent endless belts synchronously with each stop motion of the belts. With an elapse of a predetermined length of time after the contact with the belts, the top plates 13 are moved up away from the belts, which then simultaneously start to move together for a predetermined length of distance. After movement of the endless belts 11 and 12 with the veneer sheets T for the above distance, they are stopped again with simultaneous movement of the top heating plates 13 down to their operative heating positions. Such movement and stop are performed alternately during the intermittent movement of the endless belts 11, 12, and the veneer sheets T are dried progressively and finally delivered out of the dryer at the right end thereof.

After each desired number of stops of the endless belts 11, 12 during the intermittent movement, the second control unit 19 receives a control signal from the first control unit 16*b* and operates on the actuators 18 to thereby move the tension rolls 18 in the direction which causes the endless belts 11, 12 to be loosened. Substantially simultaneously, the control unit 19 provides a signal to the actuators 17*a*, which in turn act on the pushers 17 so that the endless belts 11, 12 may be moved back to the area for their normal running track if they are then displaced in either direction from such area.

As it is now apparent from the above description, according to the method of the present invention, the displacement of endless belts of a pair in either lateral direction or different ways in opposite directions can be successfully corrected by appropriate means such as pusher. This method is also effective for the correction of such displacement of the belts that may occur occasionally from the contraction of the belts caused by contact thereof with incoming green veneer sheet.

Figure 3:
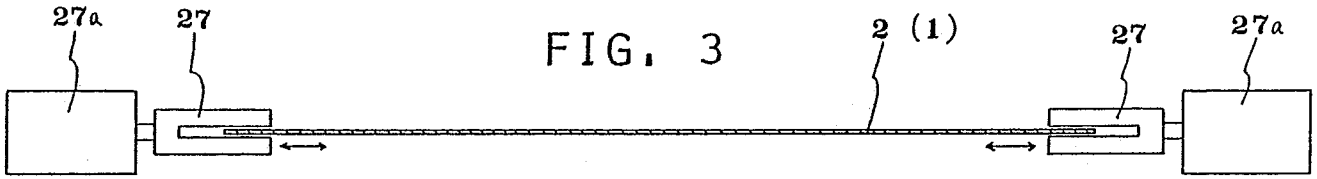
FIGS. 3 and 4 are front views showing other forms of track correcting means, respectively.
Figure 4:
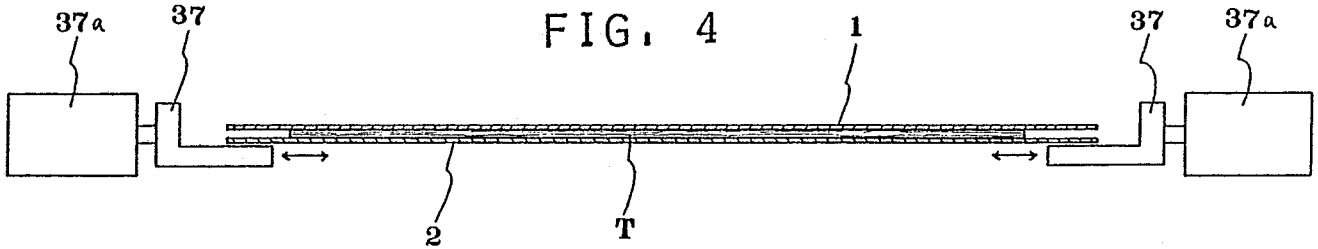

Though the pushers of a pair for returning the belts for correction of their track in the above embodiments are arc-shaped and located adjacent the peripheral edges on opposite ends of a roll where the belts are in a rigid state in engagement with the roll and therefore strong enough to resist the pushing, they may take other forms such as U-shape 27 (FIG. 3) or L-shape 37 (FIG. 4) and be operated by actuators 27*a*, 37*a*, respectively, to move toward and away from the edges of an endless belt or belts at any other convenient positions than on opposite ends of the roll. In such a case, the means for laterally moving the belts may be configured as a puller which is adapted to hold the belt at the edge on one lateral side thereof and pull it back to the area of its normal running track. As a matter of course, the area of normal running track of the belts may be established with any desired permissible error on each side depending on the working conditions such as width dimension of the heating plates, position of veneer sheet feeding, etc.

By forming the endless belt with a width whose dimension is the same as the axial length of the roll, as shown in FIG. 2, the roll ends can serve as stops to regulate the movement of the pushers, thus eliminating the need to accurately adjust their moving distance and stop positions. As an alternative way to control the operation of the pushers, it may be so arranged that a detector is provided at any convenient positions on each lateral side of the endless belts which is operable to emit a control signal in response to swerving motion of the belt in either direction and that only the pusher located on the side corresponding to the direction in which the belts are displaced from the permissible range of belt track area is actuated to move only for an adjusted distance.

In view of the ease of laterally moving the endless belts which are held between the heating plates intermittently, the belts should preferably be moved while the movable plates are positioned sufficiently clear of the belts, e.g. just before such plates are lowered or just after they are lifted. It is to noted that the present invention does not limit the time of belt movement relative to the operation of the movable heating plates. It is further noted that the belts may be moved by the pusher even while they are held by the heating plates if the amount of lateral movement is small and the belt is moved at such a portion thereof where it is not held by the plates. In such a case, the belt movement may be performed frequently, e.g. one time for each stop of the endless belts, without affecting the overall working efficiency of the dryer because the loosening, laterally moving and tightening of the endless belts can be all performed while the belts are at a stop for drying.

The piston-cylinder units as actuators, e.g. 8 and 18 used in the illustrative embodiments for tightening and loosening of the endless belts, may be replaced with a combination of separate tightening and loosening means, such as coil spring and weight for tightening of and piston-cylinder unit for loosening, respectively.

In order to secure durability of the endless belts against corroding substances such as salt contained in veneer, it is preferable that they should be made of corrosion-resistant material such as stainless steel. Additionally, a steel sheet having its surfaces electroplated and formed into an endless loop can be used advantageously.

Furthermore, the intermittent operation of the endless belts may be accomplished by directly controlling the drive unit for alternate start and stop operations, as in the case of the embodiments, or alternatively by any other suitable means such as a clutch-brake unit connected to a main drive and adapted to connect and disconnect the drive's power alternately. Additionally, the drive for the endless belts may be so arranged that the belts may be moved upwardly along the winding course of the veneer passage of FIG. 5. In order to minimize wear of the endless belts invited by friction thereof with guide rolls and veneer sheets because of the difference in speed of the two belts when moving round the periphery of the rolls as in the embodiment of FIG. 5, it is preferable that power to drive the belts should be transmitted by way of as small number of rolls as possible, e.g. through the roll **12*b*** only.

While the heating plates, e.g. 3, 13, are enforced to move up and down by piston-cylinder units **6*a*, 16*a***, it may be so arranged that the plates are lowered by their own weight without using an actuator. Furthermore, additional piston-cylinder units may be provided which can permit adjusting the contact pressure of the heating plates.

Figure 14:
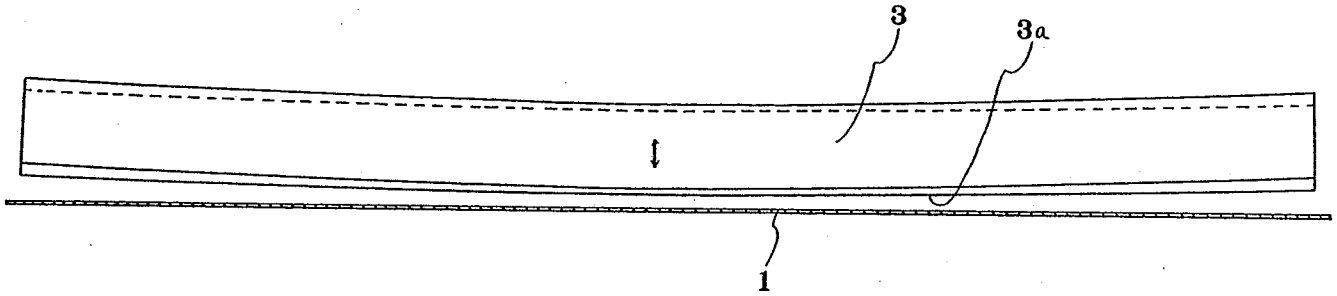
FIG. 14 is a front view of a top heating plate constructed according to a preferred form.
Figure 15:
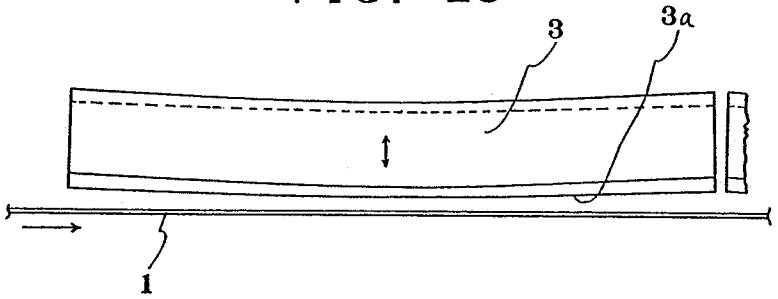
FIG. 15 is a side view of the top heating plate of FIG. 14.

For better contact of the heating plates with the endless belts, it is preferable that the plates on either side be provided in the form of individual sections and movable independently, as exemplified in the embodiments of FIGS. 1 and 5, so as to improve conformability of the plates to the belts. Though a heating plate usually has its contact surface formed flat, it has been observed by the present inventors in the experiment that such a flat plate, when cooled down by incoming green veneer, tends to be formed into a cup shape with its bottom surface concave by contraction due to the cooling, resulting in uneven contact between the belt and the heating plates. Therefore, at least part of the heating plates, particularly those plates located adjacent the inlet of the dryer where the temperature difference between the plates and veneer is greater than other locations, should preferably be so formed that their heating surfaces to be in contact with the belt are previously formed with a slight convex in any desired directions, as exemplified in FIGS. 14 and 15 wherein the contact surface **23*a* of the heating plate 23** is slightly convex shaped (the drawings being shown slightly exaggerated for the sake of clarity of the convexity) in all directions). With a heating plate having a rectangular shape which tend to be cupped, when contracted, with a greater concavity in its longitudinal direction, it should be previously formed with only a slight convexity in that direction so that, when subjected to the cooling effect of cold veneer sheet, a substantially flat surface may be obtained on the contact surface of the heating plate.

Since the desired convexity depends on various factors such as size of dimensions of the heating plate, the convexity to be formed in manufacture of the plate should be determined on the basis of experimental results. Plates with a convex surface may be manufactured in various ways, e.g. by previously forming a plate with a strain that provide its contact surface with a concave, machining the surface flat and then relieving the strain; or by forming a plate with different materials for its contact and non-contact surfaces with such different thermal expansion coefficients that may cause the plate to be expanded, when heated, with the desired convexity.

Though the embodiments of FIGS. 1, 5, 14 and 15 have been described with an assumption that the top heating plates 3, 13, 23 are placed in pressing contact engagement with the surface of their adjacent endless belt 1 or belts 11, 12 during heating with the belts at a stop, it is to be understood that the top heating plates do not have to be brought into such engagement depending on the thickness of veneer sheets to be handled. For improvement of the efficiency in heat conduction to veneer sheet, the movable heating plates should preferably be placed in close contact with the endless belt either by their own weight or under the influence of external pressure exerted by actuators, e.g. piston-cylinder units **6*a* or 16*a***. When veneer sheet is pressed tight between the heating plates by way of the belts, however, the veneer sheet is prevented from being contracted by drying, which may result in production of defects in the sheet such as cracks and splits. Such defects tend to be produced easily in relatively thin veneer sheet which is susceptible to cracking or splitting along its fibers.

Figure 16:
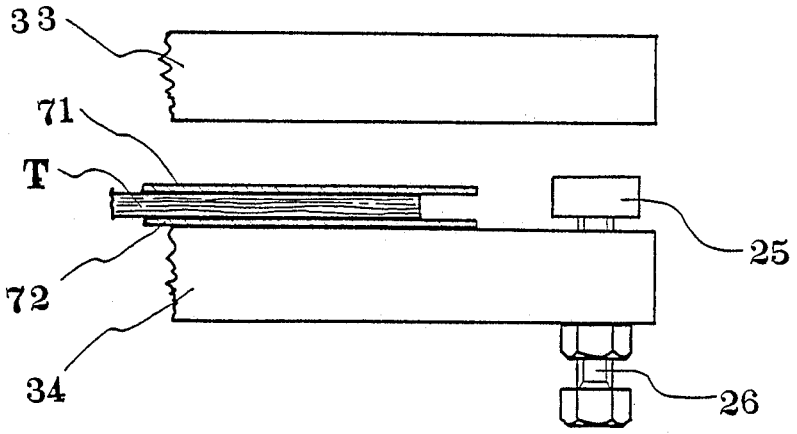
FIGS. 16 and 17 are fragmentary views showing the arrangement of heating plates and endless belts in which the top heating plate is not movable into pressing contact with, but in close proximity to, its adjacent endless belt.
Figure 17:
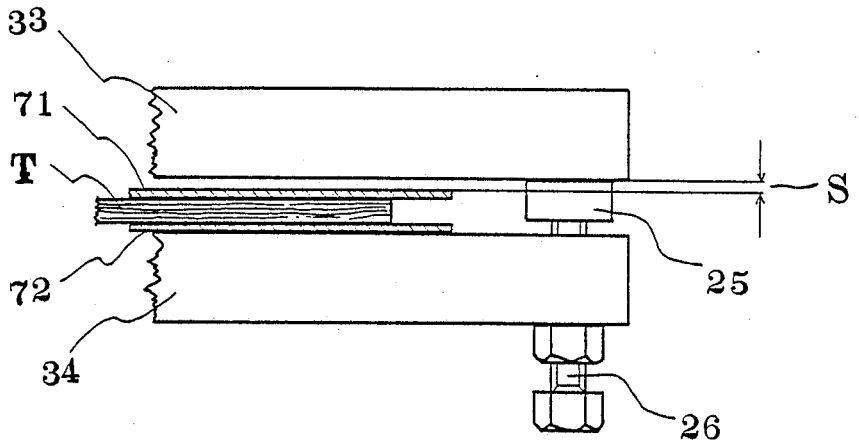

Referring to FIGS. 16 and 17, stop means 25 is provided in the lower stationary heating plate 34 for providing the lower limit of the top movable heating plate 33 so that the plate may be stopped with a clearance S left between the lower surface thereof and the top surface of the endless belt 71. By so arranging, the veneer sheet T between the endless belts 71 and 72 is free to contract and, therefore, the fear of the above-mentioned cracks and splits in veneer sheet can be forestalled. In view of the clearance S, however, a decrease in heat conduction is unavoidable and it takes longer time to dry thick veneer. It is desirable, therefore, that the clearance S should be established as small as possible for minimizing the loss of heat conduction to veneer sheet. According to the results from the experiment conducted by the present inventors, favorable drying results could be accomplished with the clearance S set less than 1 mm. With the clearance S less than 0.5 mm, still better results could be achieved.

The stop means 25 includes a bolt 26 for adjusting the position of the stop means and hence the clearance S. Though the stop means 25 is provided in the heating plate, it may be attached to any other convenient parts, e.g. a frame, of the machine. When veneer sheets to be dried have a given thickness at all times and adjustment of the clearance S is not required, the stop means 25 may be fixed non-adjustable in any suitable manner.

As to the lifting mechanism for the movable top heating plate of FIG. 5, they may be driven in various ways. For example, a bar may be used which is driven up and down cyclically by an actuator and connected to a group of vertically aligned plates by way of a pin on the plate and an elongated hole formed in the bar. Alternatively, the plates may be driven by a combination of cam and linkage which is so operable as to impart a cyclic vertical movement to the plates. When desired, it may be so constructed that both top and bottom heating plates may be provided movable.

It is to be understood that the method according to the present invention may be practiced in a dryer having a desired number of pairs of cooling plates located along the veneer passage so that the dried veneer sheet is cooled down before it is delivered out of the dryer.

Though not shown in the drawings, the heating plate may includes insulators attached on the side opposite to the contact surface thereof so as to minimize radiation of the heat from the plates.

The apparatus shown in FIG. 5 is primarily designed to convey veneer sheets in such a position that their fiber orientation is directed perpendicular relative to the direction of conveying. By using rolls having a relatively large diameter, it can be made possible to convey veneer sheet with its fiber orientation in parallel to the direction of feeding. By so feeding, the veneer sheet can be bent along a line across the fiber orientation thereof and, therefore, the stress in the sheet can be relieved effectively.

Additionally, as an alternative form of the guide rolls, they may be heated at the desired level so that they can serve as heating rolls.

While the invention has been described and illustrated specifically with reference to the desired embodiments and other possible modifications, it is to be understood that the invention can be changed or modified in various other ways without departing from the spirit or scope thereof.

What is claimed is:

1. Method of correcting the track of an intermittently running endless belt in an apparatus for drying a sheet of wood veneer, said apparatus having a pair of movable endless metal belts, a plurality of rolls, at least one of said rolls being driven to rotate intermittently, said endless belts being trained under tension round said rolls in such an arrangement along respective running track paths that at least one straight passage is formed by and between said endless belts through which a veneer sheet can be conveyed intermittently by said endless belts with intervening intervals of no belt movement, at least one pair of heating plates disposed adjacent above and below said veneer passage, at least one heating plate of the pair being movable alternately toward and away from its operative position in close proximity to its adjacent belt, in such timed relation to the intermittent movement of the endless belts that said movable heating plate is placed in said operative position synchronously with each said interval of no belt movement; said apparatus further having means provided for each of said endless belts that is operable for releasing the tension of the corresponding endless belt, and at least one pair of power driven pushing members disposed adjacent the opposite lateral edges of each of said endless belts and operable to move toward and away from said lateral edges for moving the corresponding endless belt, if deflected laterally in either direction from its running track path, back to its running track path; said method comprising: releasing the tension in said endless belts by operating said releasing means after each predetermined number of said intervals of no belt movement occurring during said intermittent movement of said belts, and thereafter, if an endless belt is deflected in either direction, by operating the corresponding pushing members, moving said deflected endless belt laterally in a direction which causes said deflected belt to return to its said running track path.

2. Method according to claim 1, wherein said moving the deflected endless belts laterally is performed while said movable heating plate is positioned in said operative position.

3. Method according to claim 1, wherein said moveable heating plate is moved to an operative position in contact engagement with its adjacent endless belt.

4. Method according to claim 1, wherein said apparatus further includes at least a pair of cooling plates disposed above and below said veneer passage.

5. Method according to claim 1, wherein said pair of pushing members are disposed adjacent the opposite ends of each roll and movable toward and away from each other, and wherein said moving the endless belt laterally back to its running track path is accomplished by pushing the belt at the edge thereof on the side corresponding to the direction in which the belt is deflected, by the pushing member adjacent to that edge.

6. Method according to claim 1, wherein said moving the deflected endless belt laterally is performed while said movable heating plate is away from said operative position.

7. Method according to claim 6, wherein said releasing the tension is performed before said movable heating plate reaches said operative position.

8. Method according to claim 6, wherein said releasing the tension is performed after said movable heating plate is moved away from said operative position.

9. Method according to claim 1, wherein said endless belts are to be trained round said rolls in such arrangement that said straight passage is formed as part of a continuous passage of a winding form including top, middle and bottom straight passages and two turns in alternating directions connecting the top and middle passages and the middle and bottom passages, respectively.

10. Method according to claim 9, wherein said pair of pushing members are disposed adjacent the opposite ends of each roll and movable toward and away from each other, and wherein said moving the endless belt laterally back to its running track path is accomplished by pushing the belt at the edge thereof on the side corresponding to the direction in which the belt is deflected, by the pushing member adjacent to that edge.

11. Method according to claim 9, wherein said pair of pushing members are disposed adjacent the opposite ends of each roll and movable toward and away from each other, and wherein said pushing members are operated toward each other substantially simultaneously to push the respective belt laterally back to its running track path.

12. Method of correcting the track of an intermittently running endless belt in an apparatus for drying a sheet of wood veneer, said apparatus having a pair of movable endless metal belts, a plurality of rolls, at least one of said rolls being driven to rotate intermittently, said endless belts being trained under tension round said rolls in such an arrangement that at least one straight passage may be formed by and between said endless belts through which a veneer sheet can be conveyed by the intermittently running endless belts and also that the endless belts may be guided normally within an allowable area for their running track, two sets of heating plates disposed above and below said veneer passage, respectively, each set including at least one heating plate and the heating plate of at least one set being movable alternately toward and away from its operative position where the movable plate is moved at least in close proximity to its adjacent endless belt, said movable heating plate being moved in such timed relation to the intermittent movement of the endless belts that it may be placed in said operative position synchronously with each stop motion of the endless belts, said method comprising:

releasing the tension to the endless belts after each predetermined number of stop motions of the endless belts during intermittent movement thereof, and moving the endless belts laterally in a direction which causes the belts, if deflected in either direction, to return to said allowable area for their running track, said moving the endless belts laterally being performed after said releasing the tension;

said apparatus further including first means provided for each of said endless belts and operable for releasing the tension of the endless belt, and second means disposed adjacent to the opposite lateral edges of said endless belts and movable toward and away from said lateral edges and operable for moving the endless belts, if deflected laterally in either direction, back to said area for their running track, wherein said releasing the tension is accomplished by operating said first means, and said moving the endless belts laterally is provided by operating said second means; and said second means including a pair of pushing members provided adjacent the opposite ends of each roll and movable toward and away from each other, and said moving the endless belts laterally is accomplished by pushing the belts at the edge thereof on the side corresponding to the direction in which the belts are deflected, by the pushing member adjacent to that edge.

13. Method of correcting the track of an intermittently running endless belt in an apparatus for drying a sheet of wood veneer, said apparatus having a pair of movable endless metal belts, a plurality of rolls, at least one of said rolls being driven to rotate intermittently, said endless belts being trained under tension round said rolls in such an arrangement that at least one straight passage may be formed by and between said endless belts through which a veneer sheet can be conveyed by the intermittently running endless belts and also that the endless belts may be guided normally within an allowable area for their running track, two sets of heating plates disposed above and below said veneer passage, respectively, each set including at least one heating plate and the heating plate of at least one set being movable alternately toward and away from its operative position where the movable plate is moved at least in close proximity to its adjacent endless belt, said movable heating plate being moved in such timed relation to the intermittent movement of the endless belts that it may be placed in said operative position synchronously with each stop motion of the endless belts, said method comprising:

releasing the tension to the endless belts after each predetermined number of stop motions of the endless belts during intermittent movement thereof, and moving the endless belts laterally in a direction which causes the belts, if deflected in either direction, to return to said allowable area for their running track, said moving the endless belts laterally being performed after said releasing the tension;

and said endless belts are trained round said rolls in such an arrangement that said passage may be formed by a continuous passage of a winding form including top, middle and bottom straight passages and two turns in alternating directions connecting the top and middle passages and the middle and bottom passages, respectively, said drying apparatus further including first means provided for each of said endless belts and operable for releasing the tension of the endless belt, and the second means disposed adjacent to the opposite lateral edges of said endless belts and movable toward and away from said lateral edges and operable for moving the endless belts, if deflected laterally in either direction, back to said area for their running track, and wherein said releasing the tension is accomplished by operating said first means, and said moving the endless belts laterally is provided by operating said second means; and said second means including a pair of pushing members provided adjacent the opposite ends of each roll and movable toward and away from each other, and said moving the endless belts laterally is accomplished by pushing the belts at the edge thereof on the side corresponding to the direction in which the belts are deflected, by the pushing member adjacent to that edge.

14. Method of correcting the track of an intermittently running endless belt in an apparatus for drying a sheet of wood veneer, said apparatus having a pair of movable endless metal belts, a plurality of rolls, at least one of said rolls being driven to rotate intermittently, said endless belts being trained under tension round said rolls in such an arrangement that at least one straight passage may be formed by and between said endless belts through which a veneer sheet can be conveyed by the intermittently running endless belts and also that the endless belts may be guided normally within an allowable area for their running track, two sets of heating plates disposed above and below said veneer passage, respectively, each set including at least one heating plate and the heating plate of at least one set being movable alternately toward and away from its operative position where the movable plate is moved at least in close proximity to its adjacent endless belt, said movable heating plate being moved in such timed relation to the intermittent movement of the endless belts that it may be placed in said operative position synchronously with each stop motion of the endless belts, said method comprising:

releasing the tension to the endless belts after each predetermined number of stop motions of the endless belts during intermittent movement thereof, and moving the endless belts laterally in a direction which causes the belts, if deflected in either direction, to return to said allowable area for their running track, said moving the endless belts laterally being performed after said releasing the tension;

and said endless belts are trained round said rolls in such an arrangement that said passage may be formed by a continuous passage of a winding form including top, middle and bottom straight passages and two turns in alternating directions connecting the top and middle passages and the middle and bottom passages, respectively, said drying apparatus further including first means provided for each of said endless belts and operable for releasing the tension of the endless belt, and second means disposed adjacent to the opposite lateral edges of said endless belts and movable toward and away from said lateral edges and operable for moving the endless belts, if deflected laterally in either direction, back to said area for their running track, and wherein said releasing the tension is accomplished by operating said first means, and said moving the endless belts laterally is provided by operating said second means; and said second means including a pair of pushing members provided adjacent the opposite ends of each roll and movable toward and away from each other, and said moving the endless belts laterally is accomplished by moving said pusher members toward each other substantially simultaneously.

* * * * *